US010716729B2

(12) United States Patent
Hashimoto et al.

(10) Patent No.: US 10,716,729 B2
(45) Date of Patent: Jul. 21, 2020

(54) WALKING ASSISTANCE DEVICE

(71) Applicant: ASAHI INDUSTRIES CORP., Tokyo (JP)

(72) Inventors: Akihide Hashimoto, Tokyo (JP); Noboru Fujitate, Hanamaki (JP); Masahiro Yoshida, Hanamaki (JP)

(73) Assignee: Asahi Industries Corp., Arakawa-ku, Tokyo (JP)

( * ) Notice: Subject to any disclaimer, the term of this patent is extended or adjusted under 35 U.S.C. 154(b) by 0 days.

(21) Appl. No.: 16/337,529

(22) PCT Filed: Sep. 29, 2016

(86) PCT No.: PCT/JP2016/078884
§ 371 (c)(1),
(2) Date: Mar. 28, 2019

(87) PCT Pub. No.: WO2018/061153
PCT Pub. Date: Apr. 5, 2018

(65) Prior Publication Data

US 2019/0224065 A1 Jul. 25, 2019

(51) Int. Cl.
*A61H 3/04* (2006.01)
*A45B 9/00* (2006.01)

(52) U.S. Cl.
CPC ..... *A61H 3/04* (2013.01); *A45B 2009/007* (2013.01); *A61H 2003/046* (2013.01)

(58) Field of Classification Search
CPC ..... A61H 2003/046; A61H 3/04
See application file for complete search history.

(56) References Cited

U.S. PATENT DOCUMENTS 4,261,561 A 4/1981 Ilon
6,158,453 A * 12/2000 Nasco ..... A45B 1/02 135/77

(Continued)

FOREIGN PATENT DOCUMENTS

JP 5521964 A 2/1980
JP 2007105069 A 4/2007

(Continued)

OTHER PUBLICATIONS

International Search Report (PCT/ISA/210) and Written Opinion (PCT/ISA/237) dated Dec. 20, 2016, by the Japanese Patent Office as the International Searching Authority for International Application No. PCT/JP2016/078884.

*Primary Examiner* — Noah Chandler Hawk
(74) *Attorney, Agent, or Firm* — Buchanan Ingersoll & Rooney PC

(57) ABSTRACT

A walking assistance device includes: a base frame; two front wheels, the two front wheels on a traveling side of the base frame; and one rear wheel. An operation frame including a holding grip for an operator is height-adjustably attached to the base frame. A first axle support with the axle of the front wheels fixed is attached to the base frame, whereby the front wheels retain in contact with the ground even when the operation frame tilts. The axle of the front wheels is positioned on the traveling direction side with respect to the leading end in the traveling direction of the base frame. Providing a gap and a stopper above the rear wheel and downward pressing against the holding grip allows the stopper to come into contact with the rear wheel.

4 Claims, 10 Drawing Sheets

(56) References Cited

U.S. PATENT DOCUMENTS

| | | | | |
|---|---|---|---|---|
| 6,286,843 | B1 * | 9/2001 | Lin | A63C 17/0066 280/11.28 |
| 6,494,470 | B2 * | 12/2002 | Chang | B62K 3/002 280/263 |
| 6,708,705 | B2 * | 3/2004 | Nasco, Sr. | A45B 9/00 135/66 |
| 7,261,114 | B2 * | 8/2007 | Karasin | A61H 3/00 135/85 |
| 7,673,641 | B2 * | 3/2010 | Karasin | A61H 3/00 135/75 |
| 8,020,881 | B2 * | 9/2011 | Stump | A61H 3/04 280/200 |
| 2003/0094191 | A1 | 5/2003 | Lin | |

FOREIGN PATENT DOCUMENTS

| | | | |
|---|---|---|---|
| JP | 4105731 | B2 | 6/2008 |
| JP | 2010246649 | A | 11/2010 |
| JP | 2011235051 | A | 11/2011 |
| JP | 2016190030 | A | 11/2016 |

* cited by examiner (a)

(b)

WALKING ASSISTANCE DEVICE

TECHNICAL FIELD

The present invention relates to a walking assistance device in order to enable a person with disability in a leg or the lumber to walk safely, through assistance of the movement of the person while walking in a daily life or a rehabilitation life.

BACKGROUND ART

As a tool that a pedestrian holds the tool to use like a cane, travels forward with the pedestrian, and rests like a cane with an operation, such a tool has been provided with a wheel as a mechanism of traveling forward with the pedestrian. In this case, it has been preferable to provide such a tool with two wheels, in order to allow the tool to travel forward steadily. In addition, in order to make the tool rest like a cane, a rubber tip like a tip of a cane has pressed against the ground (e.g., refer to Patent Literature 1 and 2).

CITATION LIST

Patent Literature

Patent Literature 1: JP 2011-235051 A
Patent Literature 2: JP 4105731 B2

SUMMARY OF INVENTION

Technical Problem

In the conventional technique described above, the axle of the two wheels are supported normally and supported within the frame. Thus, there has been a case of rising of one of the wheels when the entire device has tilted.

Furthermore, apart from the wheels, even during acting of the stopper in order to rest by pressing the stopper against the ground, the rotation of the wheels has kept, whereby there has been a case of losing stability when the device has functioned as a cane.

Solution to Problem

The present invention has been solved the above disadvantages by positioning a first axle of two front wheels, on the leading end side with respect to a base frame, and providing, with a stopper, the base frame positioned above a rear wheel.

That is, the present invention is a walking assistance device includes: the base frame provided with the front wheels disposed laterally on the traveling side of the base frame and the rear wheel on another side of the base frame, and an operation frame having a holding portion for an operator, and the walking assistance has a configuration as below.

(1) A base end portion of the operation frame is connected to a leading end portion in a traveling direction of the base frame.

(2) A first axle support is provided at the leading end portion in the traveling direction of the base frame, the front wheels being attached to both end portions of the axle support, respectively, such that an axle of the front wheels is positioned on a traveling direction side with respect to a leading end in the traveling direction of the base frame.

(3) The first axle bearing is formed such that the axle of the front wheels is tiltable to the base frame.

(4) A stopper portion is formed at a rear end portion in the traveling direction of the base frame.

(5) A base end portion of a second axle support is attached near the stopper portion through an elastic member, and the rear wheel is attached to a leading end portion of the second axle support.

(6) The rear wheel is disposed directly below the stopper portion and is spaced apart with a predetermined gap.

(7) The stopper portion is formed so as to press against an upper portion of the rear wheel with elimination of the gap against the elastic member due to downward pressing against the holding portion by a user, to restrict rotation of the rear wheel.

Furthermore, in the above description, the walking assistance device has a configuration as below.

(1) The first axle support provided with two number of the first axle support pieces having respective through holes formed therein, and a tubular elastic bearing is provided through the through holes.

(2) The axle of the front wheels is inserted into the through holes and the elastic bearing, the axle of the front wheels being loosely inserted into the through hole.

Furthermore, in the above description, the walking assistance device has a configuration as below.

(1) The base end portion of the second axle support is provided on a traveling direction side of the stopper portion, and the leading end portion of the second support is disposed on an opposite side to the traveling direction.

(2) An upper end portion of a shorter longitudinal body is attached on the traveling direction side on the base frame, and an upper end portion of a longer longitudinal body is attached on another side of the base frame.

(3) The base end portion of the second axle support is attached vertically movably to respective lower portions of the longitudinal bodies, the base end portion of the second axle support having a downward gradient toward the opposite side to a traveling method.

(4) A spring for energizing the second axle support in a direction away from the base frame is attached to each of the longitudinal bodies.

(5) A width of the rear wheel in an axle length direction of the rear wheel is formed sufficiently longer than a width of the base frame.

Furthermore, in the above description, the walking assistance device in which the base frame and the operation frame each include a metallic material, the holding portion of the operation frame is formed substantially horizontally, and a stopper including a curve plate is secured to a face on a rear-wheel side of the stopper portion of the base frame.

Advantageous Effects of Invention

According to the present invention, there are included: the two front wheels; the first axle thereof attached to the leading end side with respect to the base frame; the one rear wheel; the stopper provided at the base frame above the rear wheel to allow the stopper to come into contact with the rear wheel, thereby enabling stable assistance for the user's own travel with grasping the operation frame. Furthermore, the holding portion is lightly pressed and the stopper presses against the rear wheel, thereby providing an effect of reliable and stable stop.

BRIEF DESCRIPTION OF DRAWINGS

FIG. 3(*b*) is a left side view; and FIG. 3(*c*) is a rear view of the walking assistance device according to the embodiment of the present invention.

FIG. 7(*b*) is a left side view; and FIG. 7(*c*) is a front view of a first bearing piece of a first axle support used in the exploitation of the present invention.

FIG. 8(*b*) is a plan view; FIG. 8(*c*) is a front view; and (*d*) is a bottom view of a second axle support used in the exploitation of the present invention.

FIG. 10(*b*) is a perspective view of a stopper.

DESCRIPTION OF EMBODIMENTS

Embodiments of the present invention will be described with reference to the drawings. It is assumed that the traveling direction is front side and an opposite side to the traveling direction is the rear side.

1. Frame 1

(1) A frame 1 includes a base frame 3, an operation frame 10, and a reinforcing member 18.

Figure 2:
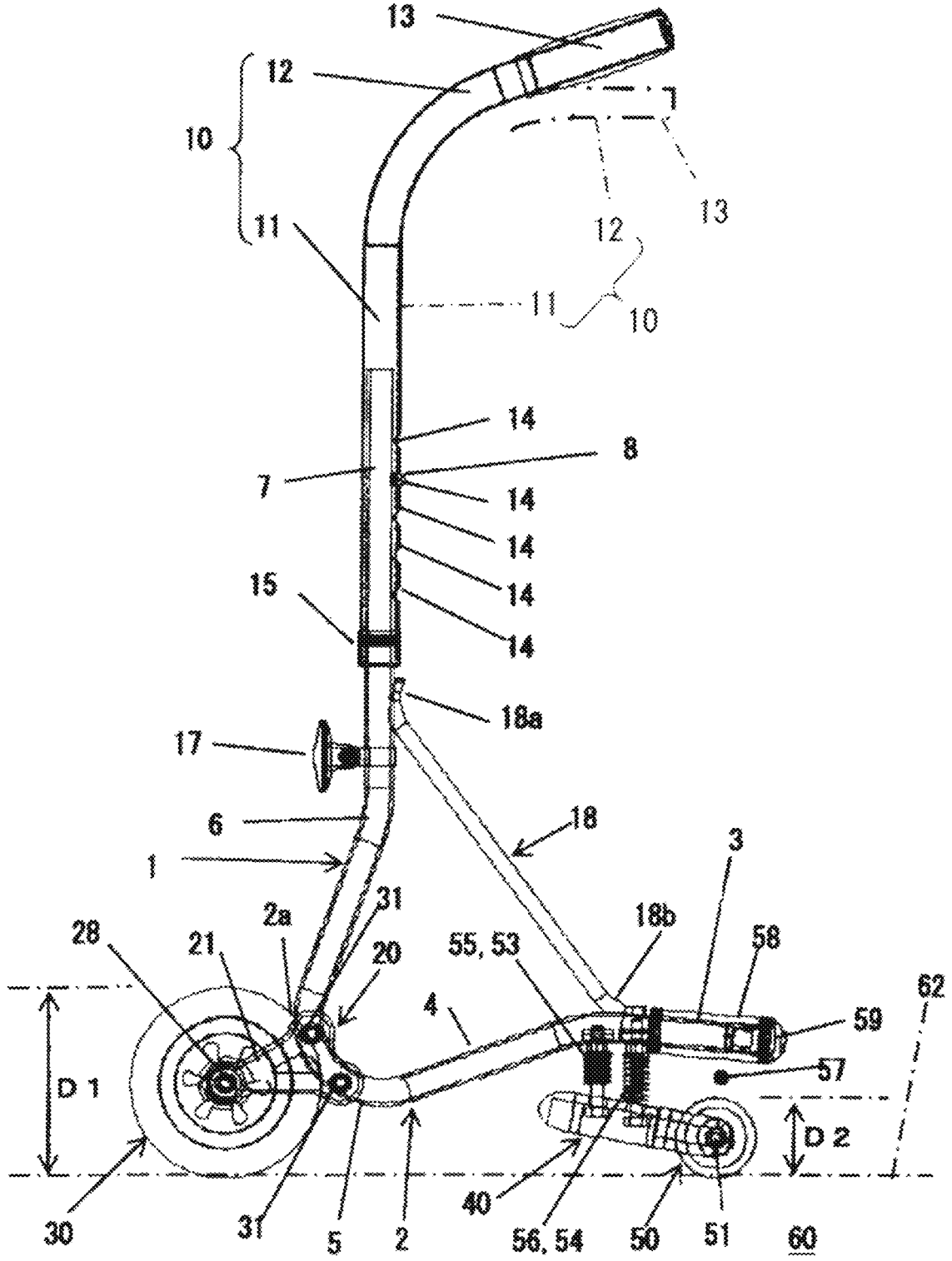
FIG. 2 is a longitudinal sectional view of the walking assistance device according to the embodiment of the present invention.

(2) The base frame 2 is made of a pipe material having a circular cross section, the base frame 2 including: in the lateral direction (substantially horizontal direction), a horizontal portion 3 formed on the rear side; an intermediate portion 4 formed with a downward gradient toward the front side following the horizontal portion 3; a curve portion 5 formed gradually rising on the front side and projecting obliquely downward on the front side, the curve portion 5 further being formed returning slightly to the rear side in the horizontal position; a rising portion 6 formed upward following the curve portion 5; and a vertical portion 7 formed substantially vertically on the leading end side of the rising portion 6. Thus, the vertical portion 7 on the rising portion 6 is slightly positioned on the rear side in the horizontal direction with respect to the end on the front side of the base frame 2 (FIG. 2).

In addition, a locking projection 8 that projects and retracts in the horizontal direction is attached onto a face on the rear side at an upper portion of the vertical portion 7. The locking projection 8 is constantly energized by a spring (not illustrated) equipped inside the pipe so as to be project by the spring, and the locking projection 8 is pushed against the spring to retract flush with a side face of the vertical portion 7.

Furthermore, a lower end portion 18*b* and an upper end portion 18*a* of the oblique reinforcing member 18 each are secured between near an end portion on the front side of the horizontal portion 3 (or near the boundary between the horizontal portion 3 and the intermediate portion 4) and the rising portion 6 (or the lower side of the vertical portion 7).

(3) The operation frame 10 includes: a linking portion 11 in the vertical direction that can be fitted onto the vertical portion 7 of the base frame 2 (that is, the linking portion 11 has an inner diameter lager than the outer diameter of the vertical portion 7); and an operation portion 12 formed by gradually curving the upper end of the linking portion 11 toward the rear side and directing lineally obliquely upward toward the rear side (about 30° from horizontal). The upper end portion (free end side) of the operation portion 12 is covered with a cylindrical rubber member to form a holding grip 13. There is adopted a material for the holding grip 13, such as a material having friction and some elasticity such that the operator does not slip when grasping holding grip 13.

In addition, the linking portion 11 has adjusting blind holes 14, 14 formed at the linking portion 11, the adjusting blind holes 14 being arranged vertically at predetermined pitch (five pieces in the present embodiment). The adjusting blind holes 14 each are formed having a size allowing insertion of the locking projection 8 of the base frame 2. Furthermore, a tubular retaining cylinder 15 is screwed outer circumferentially onto a lower end portion of the linking portion 11, and attached projecting downward the lower edge of the linking portion 11. The retaining cylinder 15 is capable of securing the linking portion 11 and the vertical portion 7 in a manner of fitting the retaining cylinder 15 outer circumferentially onto the vertical portion 7 so as to inhibit moving the linking portion 11 and the vertical portion 7.

(4) The linking portion 11 of the operation frame 10 is fitted onto the vertical portion 7 of the base frame 2, and the locking projection 8 is inserted into an adjusting blind hole 14 at the optimum position matching the user's body. Then, the retainer 15 is turned and tightened to form the frame 1. At this time, the holding grip 13 is positioned above substantially between the intermediate portion 4 and the horizontal portion 3 of the base frame 2 (at least part of the grip is positioned opposite to the horizontal portion 3) (FIGS. 1 and 2).

Figure 1:
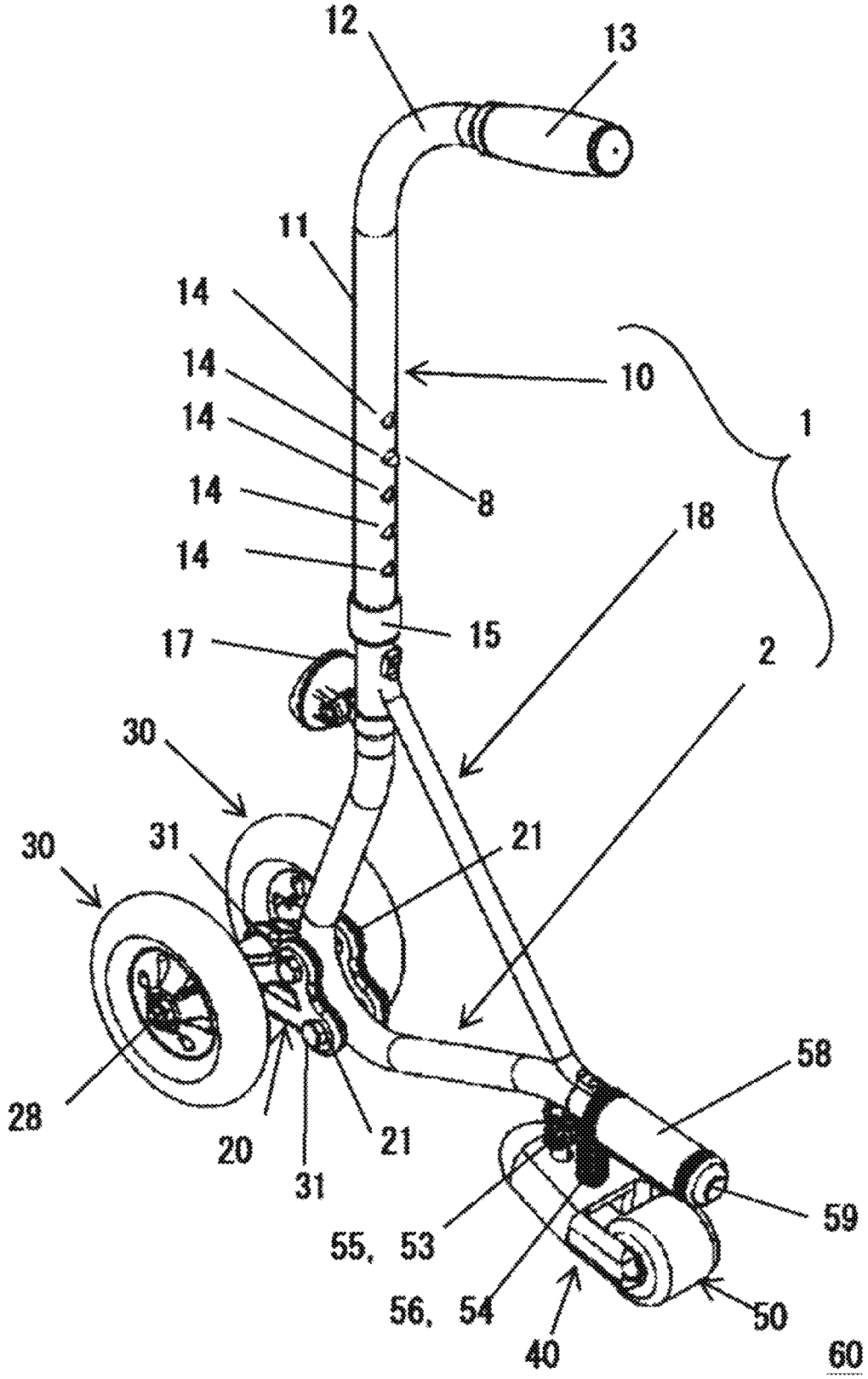
FIG. 1 is a perspective view of a walking assistance device of an embodiment of the present invention, as viewed from behind.

(5) Furthermore, a reflector 17 with a reflecting face facing the front side is attached near the lower end of the rising portion 6 (FIGS. 1 and 2).

(6) Note that the frame 1 is disassemblable into the base frame 2 and the operation frame 10, thereby providing convenience in storage and carrying. The frame 1, however, may also include the base frame 2 and the operation frame 10 integrally formed so as not to be disassemblable (not illustrated).

2. Front Wheels 30

Figure 5:
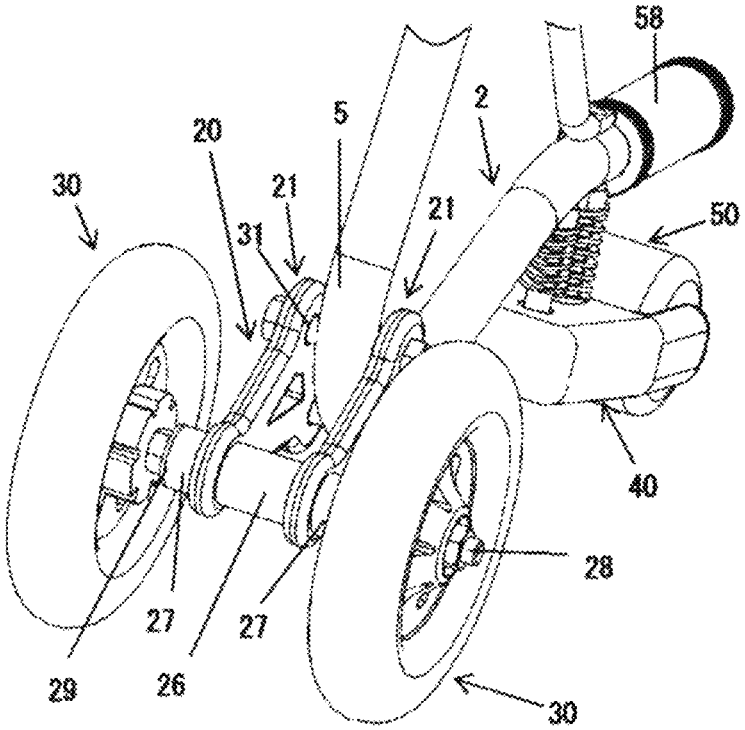
FIG. 5(*a*) is a partially enlarged perspective view on the front-wheel side and FIG. 5(*b*) is a partially enlarged longitudinal cross-sectional view on the rear-wheel side of the walking assistance device according to the embodiment of the present invention.
Figure 5:
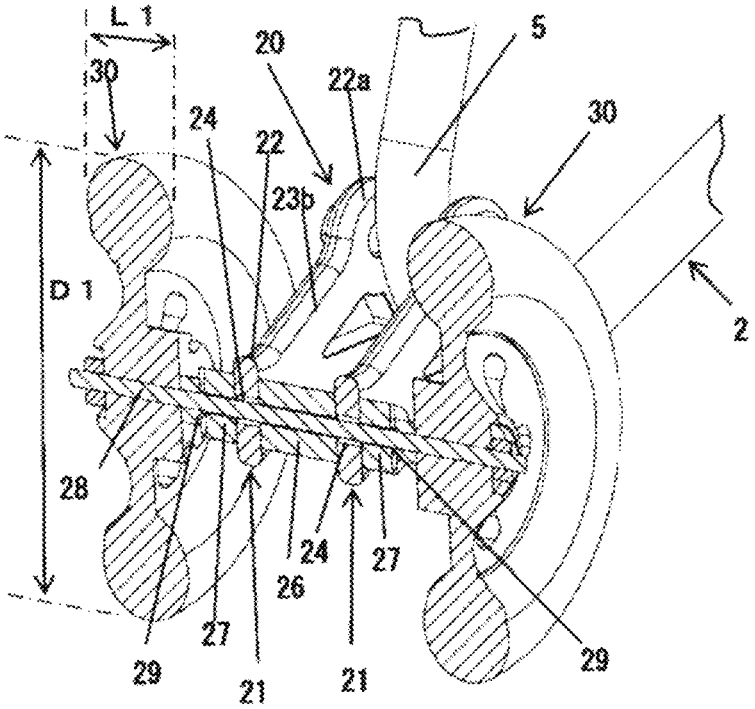

(1) A first axle support 20 for receiving the front wheels 30 includes two first axle bearing pieces 21, 21 and elastic bearings 26, 27 held thereby (FIG. 5).

(2) Each of the first axle bearing pieces 20 is in the form of a triangular plate having through holes 24, 24*a*, and 24*b* near the vertexes of a right triangle consisting of a short side, a long side, and an oblique side substantially perpendicular to each other. Corner portions 22, 22*a*, and 22*b* sufficiently larger in diameter than the through holes 24, 24*a*, and 24*b* are formed around the through holes 24, 24*a*, and 24*b*, respectively. Side portions 23*a*, 23*b*, and 23*c* larger in width than the through holes 24, 24*a*, and 24*b* are respectively formed at portions corresponding to the sides of a triangle connecting the through holes 24, 24*a*, and 24*b*. A remaining opening 25 is formed centrally. The side portions include the side portion 23*a* corresponding to the short side; the side portion 23*b* corresponding to the long side; and the side portion 23*c* corresponding to the oblique side of the right triangle.

(3) The side portion 23*a* corresponding to the short side of each of the two first axle bearing pieces 21, 21 is disposed on the curve portion 5 on the front side of the base frame 2. The through holes 24*a* and 24*b* are disposed at the diameter position of the pipe of the curve portion 5. The first axle bearing pieces 21, 21 are attached to the base frame 2 such that the through holes 24*a* of the first axle bearing pieces 21, 21 are respectively positioned at both end portions of a bolt 31 horizontally penetrating through the base frame 2. Furthermore, the through holes 24*b* of the first axle bearing pieces 21, 21 are attached to the base frame 2 at a different position such that the through holes 24*b* of the first axle bearing pieces 21, 21 are respectively positioned at both end portions of another bolt 31 horizontally penetrating through the base frame 2. At this time, the side portion 23*c* corresponding to the oblique side is disposed substantially horizontally (FIGS. 2 and 7(*c*)).

Figure 7:
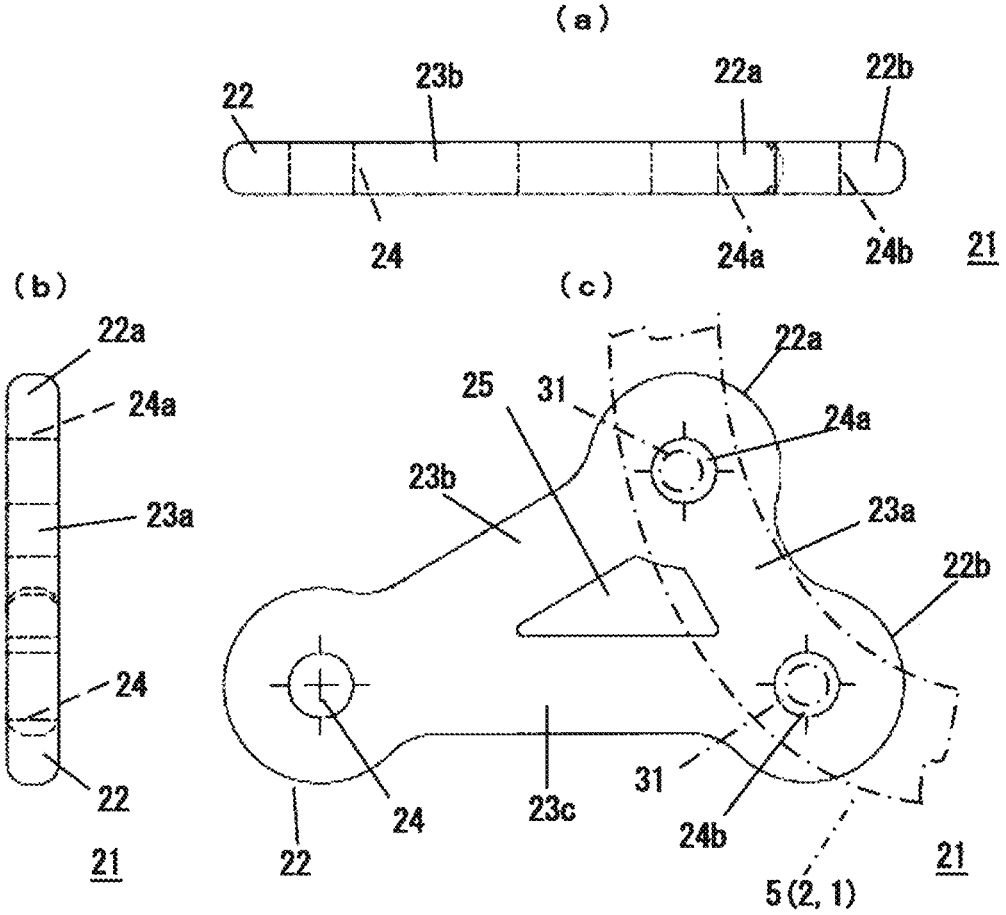
FIG. 7(*a*) is a plan view.

Here, the through holes 24*a* and 24*b* are formed larger in diameter than the body of each bolt 31 such that the bolt 31 is movable within the through holes 24*a* or 24*b* (FIG. 7(*c*)), and the first axle 28 remains horizontally even when the frame 1 (base frame 2 and the operation frame 10) inclines and moves. Note that, here, in order to have a similar effect, the bolts 31, 31 can also be loosely attached to the base frame 2 (not illustrated).

The first axle 28 is disposed in the through hole 24 at the position where the side portion 23*b* and the side portion 23*c* overlap each other. An elastic bearing 26 having a tubular shape (columnar shape with a hole along the central axis of the columnar shape) is attached between the first axle support piece 21 and the other first axle support piece 21, on the outer circumferential side of the first axle 28. In addition, the cylindrical elastic bearings 27 are also attached to the outside of the first axle support pieces 21, 21, respectively, on the outer circumferential side of the first axle 28. Each of washers 29 is attached to the first axle 28 the outside of each of the elastic bearings 27, and the elastic bearing 27, the first axle bearing piece 21, the elastic bearing 26, the other first axle bearing piece 21, and the other elastic bearing 27 are interposed between the washers 29, 29.

Here, it is preferable that the material of the elastic bearings 26, 27 have: substantially the same cross-sectional shape; a certain degree of hardness and strength as a bearing; and a certain degree of softness and resilience capable of absorbing inclination of the frame. For example, a material containing ester polyurethane is adopted; however, a different material having similar properties can also be adopted. In addition, the elastic bearing 26 in the axial direction is formed longer than the elastic bearings 27.

Figure 4A:
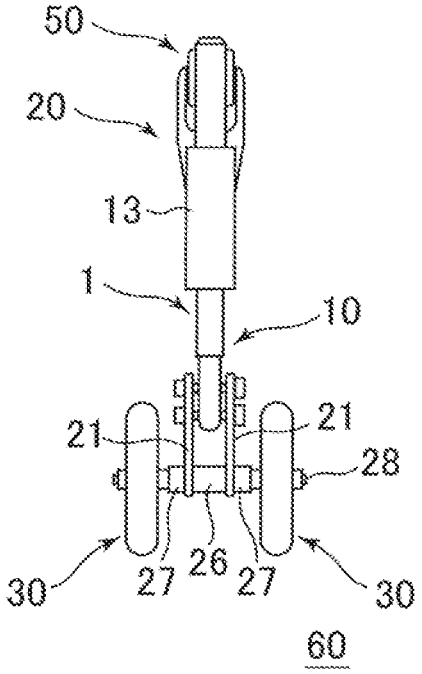
FIG. 4(*a*) is a plan view and FIG. 4(*b*) is a bottom view of the walking assistance device according to the embodiment of the present invention.
Figure 4B:
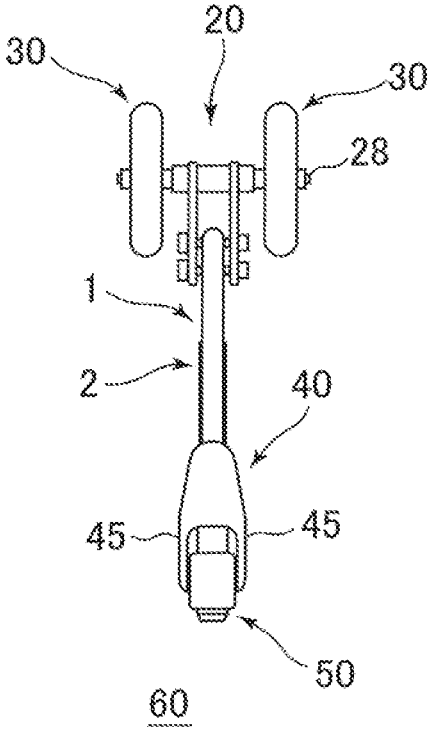

The front wheels 30, 30 with a width L1 and an outer diameter D1 are respectively attached to the outside of the washers 29, 29 at the first axle 28 (FIG. 4). Each of the washers 29 is attached with a nut for retaining each of the front wheels 30 at that position so as to maintain the position in the axial direction of the first axle 28 at that position.

The inner diameter of the respective through holes 24 of the first axle bearings 21, 21 is formed larger than the outer diameter of the first axle 28 such that the first axle 28 is rotatable. Note that each inner diameter of the through holes 24 may also be formed sufficiently larger than the outer diameter of the first axle 28 such that the first axle 38 is movable further diagonally by axle shifting to the first axle bearing 21 (not illustrated).

Furthermore, each inner diameter of the elastic bearings 26, 27 is formed slightly larger than the outer diameter of the first axle 28 (smaller than each inner diameter of the through holes 24), and attached such that the first axle 28 is movable diagonally by axle shifting to the first axle bearing 21.

(4) In the above description, the first axle bearing pieces 21 and the elastic bearings 26, 27 are attached while being pressed to a degree by the washers 29. Furthermore, a contact face between the first axle bearing pieces 21, 21 and the elastic bearings 26, 27 can also be secured by a method such as bonding.

In addition, in the above description, the first axle bearing pieces 21 and the base frame 2 are normally secured so as not to move. However, it can also be set that the bolts and nuts are attached loosely such that the first axle bearing pieces 21 slightly move to the base frame 2. In this case, even when the base frame 2 inclines more largely, the two front wheels 30, 30 can be more reliably grounded to make one of the front wheels 30, 30 difficult to rise.

Figure 6:
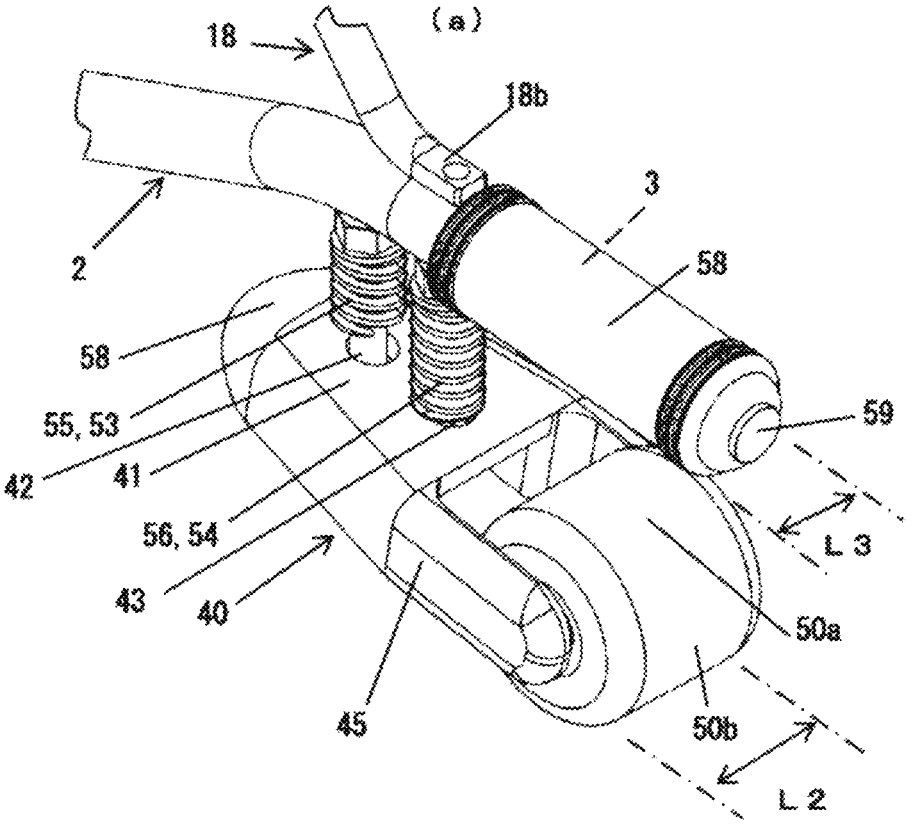
FIG. 6(*a*) is a partially enlarged perspective view on the rear-wheel side and FIG. 6(*b*) is a partially enlarged longitudinal cross-sectional view on the rear-wheel side of the walking assistance device according to the embodiment of the present invention.
Figure 6:
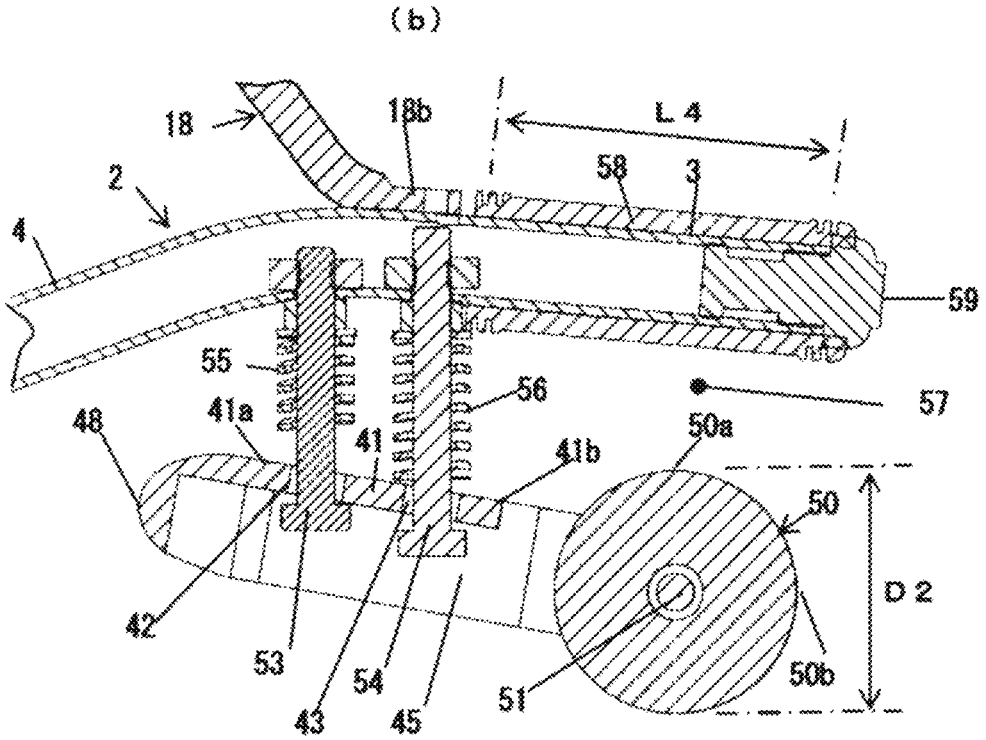

(5) The position of the axle 28 of the front wheels forward the front end 2*a* of the base frame 2 (FIGS. 6(*b*) and 2) stabilizes traveling. Thus, although the first axle support 20 including the first axle bearing pieces 21 are required, the structure of the first axle support 20 can also be taken another structure as long as the first axle support 20 can be attached to the base frame 2 and the axle 28 of the front wheels 30 can be fixed (not illustrated).

Figure 3A:
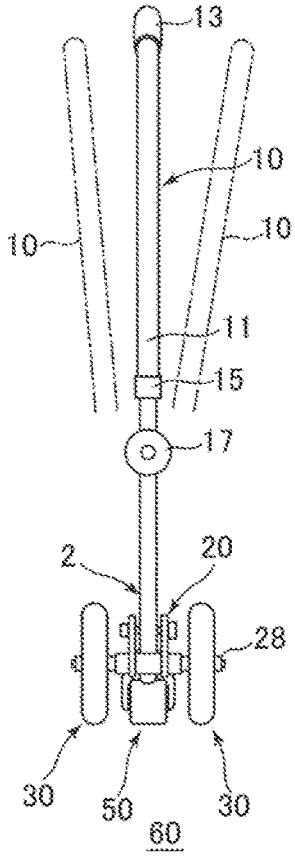
FIG. 3(*a*) is a front view.
Figure 3B:
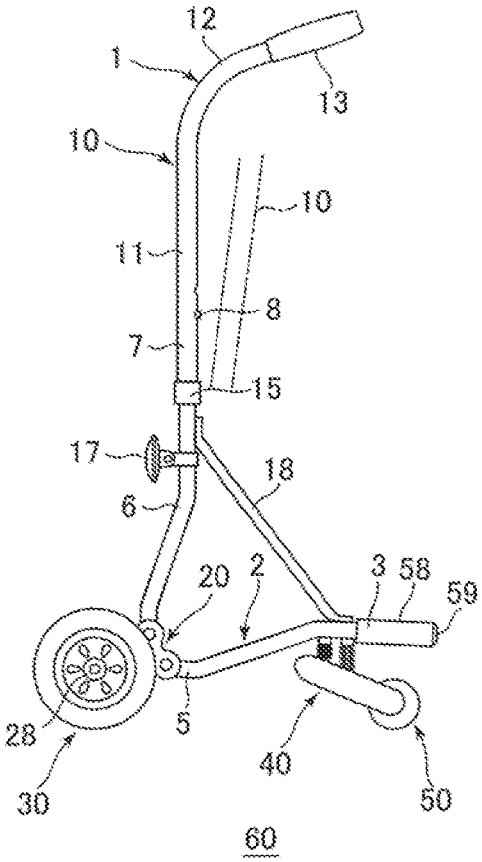
Figure 3C:
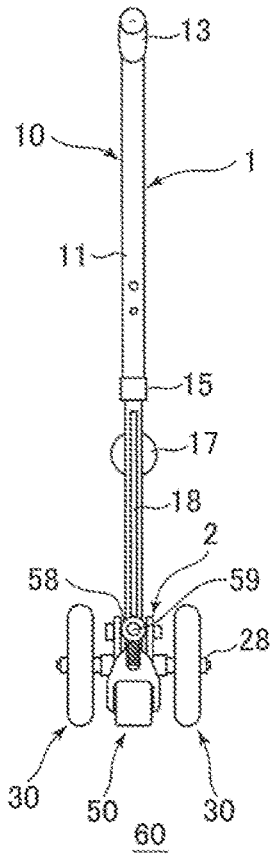

In addition, even when the operation frame 10 tilts (FIGS. 3(*a*) and 3(*b*)) and the base frame 2 inclines more largely, the axle 28 of the front wheels 30 can also be directly secured to the frame 2 without providing of the first axle bearing pieces 21, 21, as long as the two front wheels 30, 30 can be reliably grounded to make one of the front wheels 30 difficult to rise (not illustrated).

3. Rear Wheel 50 and Stopper 58

Figure 8:
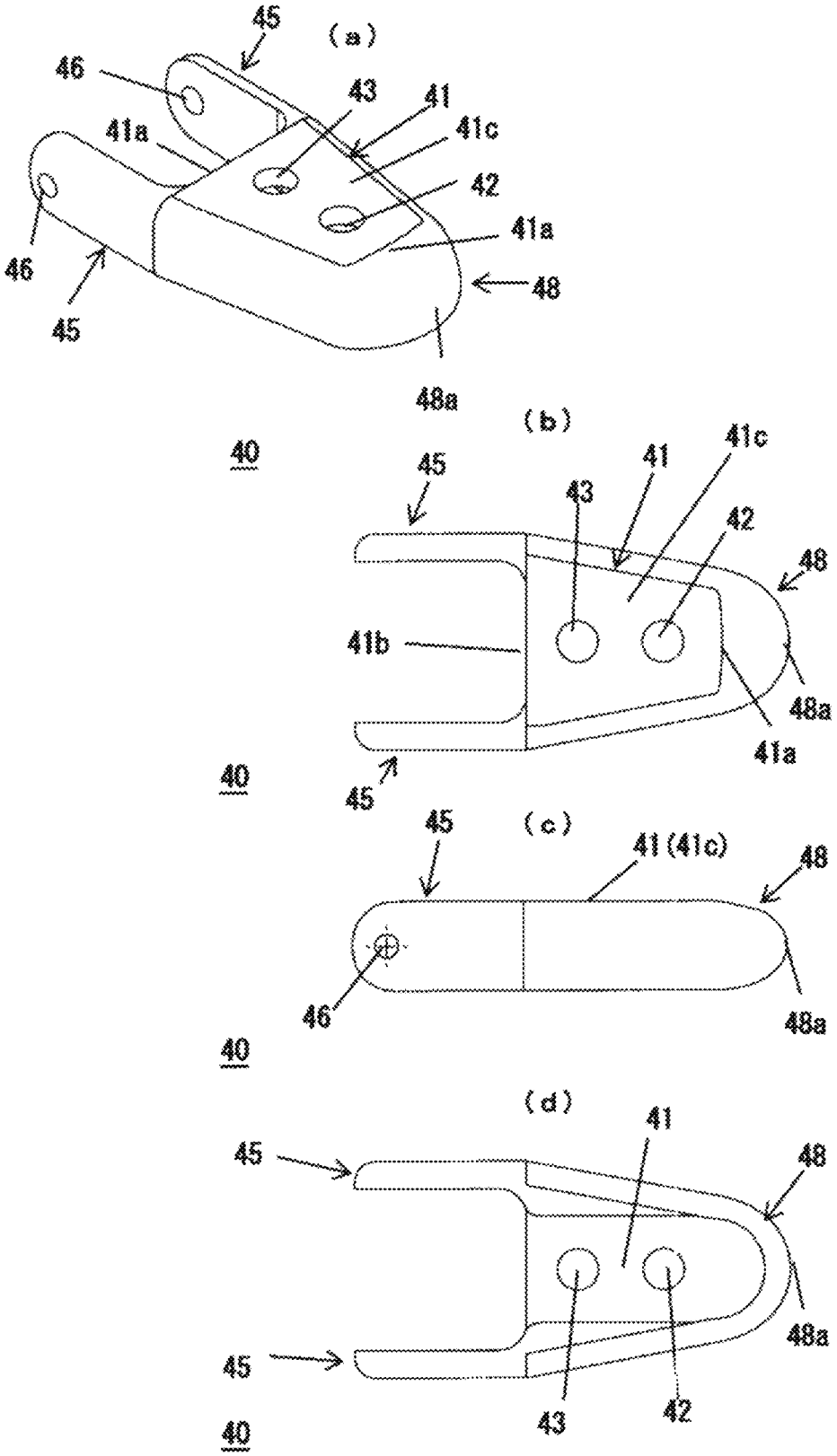
FIG. 8(*a*) is a perspective view.

(1) A second axle support 40 is integrally formed by connecting second bearing pieces 45, 45 in the substantially vertical direction, to both sides of a base plate 41 having a substantially horizontal flat-plate shape and the rear side of the base plate 41, and connecting a front covering member 48 to the front side of the base plate 41 (FIG. 8). A front through hole 42 and a rear through hole 43 arranged in the forward and rearward direction, in the base plate 41. In addition, each of axle through holes 46 is formed at the respective rear end portions of the second bearing pieces 45, 45, the axle through holes 46 allowing insertion of the axle 51 of the rear wheel through the axle through holes 46.

Furthermore, the base plate 41 is trapezoidal in shape in which a front edge 41*a* is narrower and a rear edge 41*b* is larger in width, and the second bearing pieces 45, 45 are continued parallelly toward the rear side while maintaining the pitch of the width of the rear edge 41*b*. The second bearing pieces 45, 45 are formed with substantially the same height. In addition, the front covering member 48 is connected at the width of the front edge 41*a* of the base plate 41 and the height of the front side of each second bearing piece 45. The front covering member 48 gradually narrows the width and height of the front covering member 48 forward and a leading end portion 48*a* is formed spherically (FIG. 8).

(2) A rear wheel 50 is formed with a wide width having a contact area with a diameter D2 (<D1) and a width L2 (>width L1 of the front wheel 30). The second axle 51 of the rear wheel 50 is fixed to the respective axle through holes 46, 46 of the second bearing pieces 45, 45, and the upper end

50*a* of the rear wheel 50 sufficiently projects upward the upper face 41*c* of the base plate 41 (FIG. 6(*b*)).

(3) A bolt 53 is inserted into the front through hole 42 and a bolt 54 is inserted into the rear through hole 43 respectively, from the lower face side of the base plate 41 of the second axle bearings 45 to project the bolts 53, 54 upward the upper face 41*a* of the base plate 41, and the leading ends of the bolts 53 and 54 each are secured to the lower face side of the base frame 2. At this time, the rear end 50*b* of the rear wheel 50 is disposed in the horizontal direction to be positioned near the rear end of the base frame 2. Each of the bolts 53 and 54 is secured to near the horizontal portion 3 or the boundary between the horizontal portion 3 and the intermediate portion 4 of the base frame 2 (near a portion slightly inclined where the curve starts gradually downward from the horizontal portion 3, or near the lower end portion 18*b* of the reinforcing member 18).

The respective bodies of the bolts 53 and 54 are disposed substantially in parallel. The bolt 54 on the rear side is formed longer than the bolt 53 on the front side, and the second axle support 40 (the base plate 41, the second axle bearing pieces 45) is disposed with a downward gradient toward the rear side. In addition, springs 55, 56 are respectively fitted into the front and rear bolts 53, 54, between the upper face 41*a* of the base plate 41 and the base frame 2. For the springs 55, 56 as well, the spring 55 of the bolt 53 on the front side is formed shorter than the spring 56 and the spring 56 of the bolt 54 on the rear side is formed longer than the spring 55, and the springs 55, 56 are constantly compressed in a repelling direction (FIGS. 6(*a*) and 6(*b*)).

(4) The entire circumference on the rear end portion side at the horizontal portion 3 of the base frame 3 is covered with a tubular material having a certain degree of friction and cushioning property on the surface of the material such as a rubber material to form a stopper 58. The stopper 58 with a length L4 and an outer diameter L3 in the horizontal direction (forward and rearward direction) forms a lattice-shaped irregular pattern on the outer surface of the stopper 58 (FIG. 6). The stopper 58 is formed such that the length L4 is approximately the same as or longer than the diameter D2 of the rear wheel 50 and the axle 51 of the rear wheel 50 is positioned near the intermediate of the stopper 58 in the forward and rearward direction (horizontal direction). A gap 57 is formed between the lower face of the stopper 58 and the upper end 50*a* of the rear wheel 50 (FIG. 6).

The width L2 of the rear wheel 50 is sufficiently formed larger than the diameter L3 of the stopper 58 (length in the width direction of the rear wheel 50) such that the stopper 58 can reliably come in to contact with the rear wheel 50.

Furthermore, a rear lamp 59 is attached to the rear end of the base frame 2. The rear lamp 59 also serves as a switch. Pushing of the rear lamp 59 allows switching among "light-off state, blinking state, and light-on state", and emits, for example, red light in the light-on state and the blinking state.

4. Walking Assistance Device 60

As described above, a walking assistance device 60 of the present invention has such a configuration (FIGS. 1 to 4).

5. Use of Walking Assistance Device 60

(1) As described above, the user assembles the walking assistance device 60 by inserting the linking portion 11 of the operation frame 10 onto the vertical portion 7 of the base frame 2, inserting the locking projection 8 into the adjusting blind hole 14 at the optimum position matching the user's body, turning and tightening the retainer 15, and securing the base frame 2 to the operation frame 10 (FIGS. 1 and 2).

(2) The user grasps the holding portion lip 13, puts the wheels 30, 50 contact with the ground 62, places the walking assistance device 60 alongside the body, and walks forward while making the walking assistance device 6 travel. At this time, even when the user's arm swings and the operation frame 10 (the base frame 2) swings laterally in the traveling direction (FIG. 3(*a*), chain lines 10, 10), the first axle support 20 absorbs the swing to maintain the axle 28 substantially horizontally, and the front wheels 30, 30 and the rear wheel 50 remain in contact with the ground, whereby the walking assistance device 60 can travel safely. In addition, even when the user's arm swings and the operation frame 10 (the base frame 2) swings rearward in the traveling direction (FIG. 3(*b*), chain line 10), the springs 55, 56 absorb the swing to maintain the axle 28 substantially horizontally, the front wheels 30, 30 and the rear wheel 50 remain in contact with the ground, and there is no possibility that the stopper 58 activates, whereby the walking assistance device 60 can travel safely. Note that the walking assistance device 60 can be used either outdoors such as roads or indoors such as living spaces.

(3) In addition, at this time, turning on or blinking the rear lamp 59 attracts the user's attention to behind the user, and the reflector 17 attracts the user's attention to a vehicle (automobile or bicycle) or another pedestrian approaching from the front side, thereby securing the safety of the user.

Figure 9:
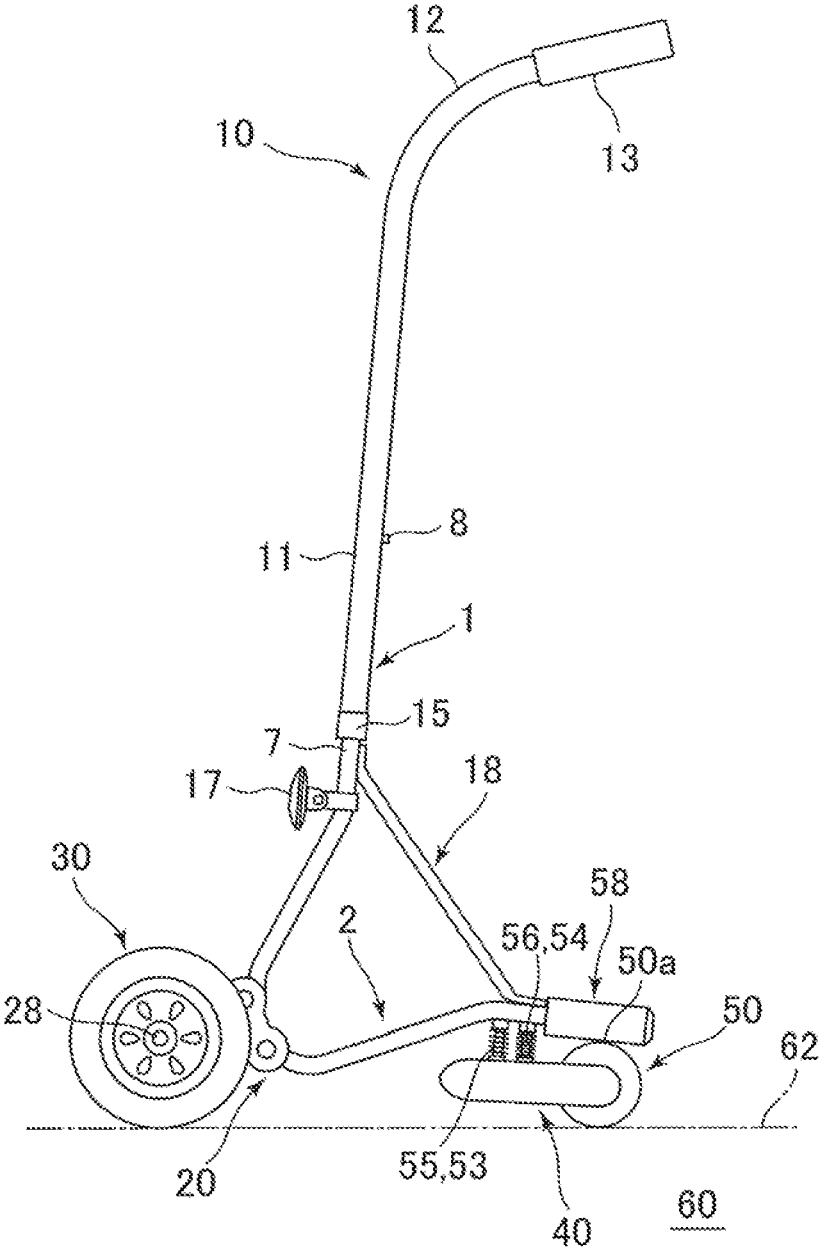
FIG. 9 is a left side view of a state of stop with brakes applied in use of the present invention.

(4) On the other hand, in a case where the user desires to stop traveling of the walking assistance device 60, when a force is applied by pressing downward the holding grip 13, the rear side of the base frame descends against the springs 55, 56 to eliminate the gap 57. Then, the stopper 58 presses the upper end 50*a* of the rear wheel 50 to stop the rotation of the rear wheel 50, whereby the walking assistance device 60 can stop safely (FIG. 9).

In addition, pressing downward the holding grip 13 and releasing the force by the user allow the springs 55, 56 to secure the rotation of the rear wheel 50.

6. Different Embodiment of Walking Assistance Tool 60

(1) In the above embodiment, the entire circumference on the rear end portion side at the base frame 3 is covered with a tubular material having a certain degree of friction and cushioning property on the surface of the material such as a rubber material to form the stopper 58. The material and shape of the stopper 58, however, are optional as long as the stopper 58 presses against the rear wheel 50 to enable stop of the rotation of the rear wheel.

Figure 10A:
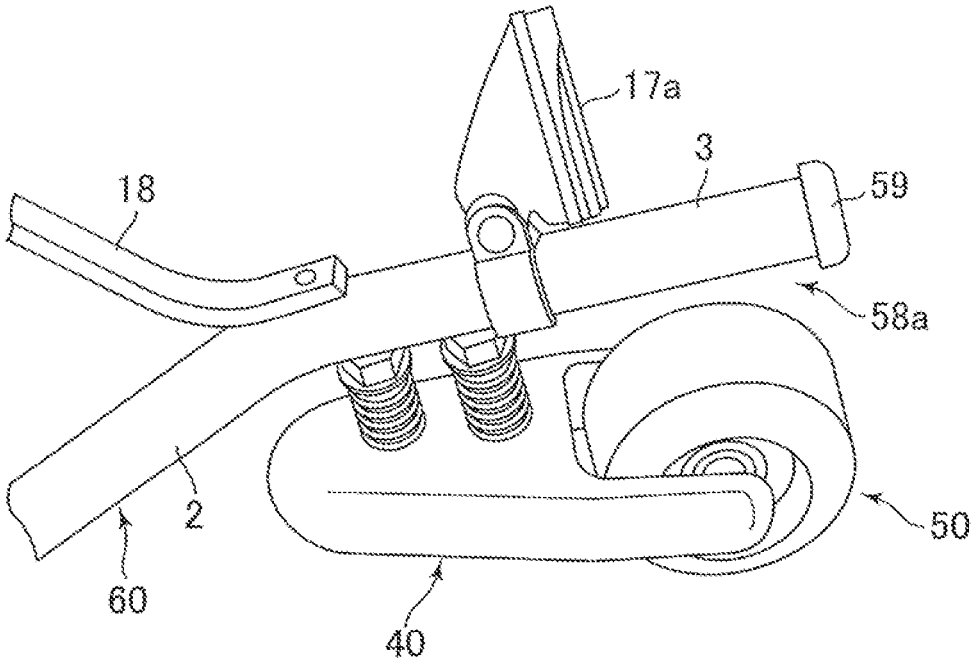
FIG. 10(*a*) is a different embodiment of the present invention and FIG. 10(*a*) is a perspective view of a rear end portion.
Figure 10B:
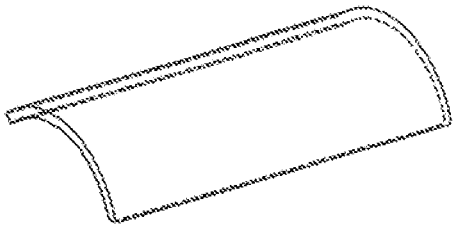

In this case, for example, a stopper 58*a* can also be formed with a partially cylindrical curve plate having an inner diameter corresponding to the outer shape of a base frame 3 (rear end side), by using a metallic plate such as a stainless steel material (see FIG. 10(*b*)). In this case, the stopper 58*a* is secured and attached to the lower face on the rear end portion side of the base frame 3 so as to be able to press against the upper side of a rear wheel 50 (FIG. 10(*a*)). The stopper 58*a* being attached (FIG. 10(*a*)) is illustrated upside down in a perspective view (FIG. 10(*b*)). With such a configuration, there are provided a simple shape and easy replacement.

(2) In addition, in the above embodiment, the reflector 17 is provided near the lower end of the rising portion 6. The installation position, however, is optional as long as the reflecting face faces the front side (not illustrated).

Furthermore, instead of the reflector 17 with the reflecting circle facing the front side, or further together with a reflector 17 with the reflecting face facing the front side, there can also be attached a reflector 17*a* with the reflecting face facing the rear side (FIG. 10(*a*)). In this case, the reflector is provided on the front side adjacent the stopper 58*a* at the rear end side of the base frame 3 so as to be positioned above the rear end portion side of the base frame 3 (FIG. 10(*a*)). Attaching the reflector 17*a* with the reflecting face facing the rear side also allows omission of a rear lamp 59 (not illustrated).

(3) Furthermore, in the above embodiment, the operation portion 12 of the operation frame 10 is formed having the obliquely upward shape; however, the operation portion 12 may also be formed substantially horizontally. In this case as well, a holding grip 13 is similarly formed on the leading end side (free end side) of an operation portion (FIG. 2, chain lines 12 and 13).

REFERENCE SIGNS LIST

1 frame
2 base frame of frame
3 horizontal portion (base frame)
4 intermediate portion (base frame)
5 curve portion (base frame)
6 rising portion (base frame)
7 vertical portion (base frame)
8 locking projection (base frame)
10 operation frame of frame
11 linking portion (operation frame)
12 operation portion (operation frame)
13 holding grip (operation frame)
14 adjusting blind hole (operation frame)
15 retaining cylinder (operation frame)
17, 17*a* reflector
18 reinforcing member (frame)
20 first axle support
21 first axle bearing piece of the first axle support
22, 22*a*, 22*b* corner portion (first axle bearing piece)
23*a*, 23*b*, 23*c* side portion (first axle bearing piece)
24, 24*a*, 24*b* through hole (first axle bearing piece)
25 remaining opening (first axle bearing piece)
26, 27 elastic bearing of first axle support
28 first axle
29 washer of first axle support
30 front wheel
31 bolt
40 second axle support
41 base plate of second axle support
42 front through hole (base plate)
43 rear through hole (base plate)
45 second bearing piece of second axle support
46 axle through hole (second bearing piece)
48 front covering member of second axle support
50 rear wheel
50*a* upper end of rear wheel
50*b* rear end of rear wheel
51 second axle
53, 54 bolt
55, 56 spring
58, 58*a* stopper
59 rear lamp
60 walking assistance device
62 ground

The invention claimed is:

1. A walking assistance device comprising:

a base frame provided with front wheels disposed laterally on a traveling side of the base frame and a rear wheel on another side of the base frame; and an operation frame having a holding portion for an operator, wherein (1) a base end portion of the operation frame is connected to a leading end portion in a traveling direction of the base frame, (2) a first axle support is provided at the leading end portion in the traveling direction of the base frame, the front wheels being attached to both end portions of the first axle support, respectively, such that an axle of the front wheels is positioned on a traveling direction side with respect to a leading end in the traveling direction of the base frame, (3) a first axle bearing piece is formed such that the axle of the front wheels is tiltable to the base frame, (4) a stopper portion is formed at a rear end portion in the traveling direction of the base frame, (5) a base end portion of a second axle support is attached near the stopper portion through an elastic member, and the rear wheel is attached to a leading end portion of the second axle support, (6) the rear wheel is disposed directly below the stopper portion and is spaced apart with a predetermined gap, (7) the stopper portion is formed so as to press against an upper portion of the rear wheel with elimination of the gap against the elastic member due to downward pressing against the holding portion by a user, to restrict rotation of the rear wheel, (8) the first axle support provided with two number of the first axle support pieces having respective through holes formed therein, and a tubular elastic bearing is provided through the through holes, and (9) the axle of the front wheels is inserted into the through holes and the elastic bearing, the axle of the front wheels being loosely inserted into the through hole.

2. The walking assistance device according to claim 1, wherein the base frame and the operation frame each include a metallic material, the holding portion of the operation frame is formed substantially horizontally, and a stopper including a curve plate is secured to a face on a rear-wheel side of the stopper portion of the base frame.

3. A walking assistance device comprising:

a base frame provided with front wheels disposed laterally on a traveling side of the base frame and a rear wheel on another side of the base frame; and an operation frame having a holding portion for an operator, wherein (1) a base end portion of the operation frame is connected to a leading end portion in a traveling direction of the base frame, (2) a first axle support is provided at the leading end portion in the traveling direction of the base frame, the front wheels being attached to both end portions of the first axle support, respectively, such that an axle of the front wheels is positioned on a traveling direction side with respect to a leading end in the traveling direction of the base frame, (3) a first axle bearing piece is formed such that the axle of the front wheels is tiltable to the base frame, (4) a stopper portion is formed at a rear end portion in the traveling direction of the base frame, (5) a base end portion of a second axle support is attached near the stopper portion through an elastic member, and the rear wheel is attached to a leading end portion of the second axle support, (6) the rear wheel is disposed directly below the stopper portion and is spaced apart with a predetermined gap, (7) the stopper portion is formed so as to press against an upper portion of the rear wheel with elimination of the gap against the elastic member due to downward pressing against the holding portion by a user, to restrict rotation of the rear wheel, (8) the base end portion of the second axle support is provided on a traveling direction side of the stopper portion, and the leading end portion of the second axle support is disposed on an opposite side to the traveling direction, (9) an upper end portion of a shorter longitudinal body is attached on the traveling direction side on the base frame, and an upper end portion of a longer longitudinal body is attached on another side of the base frame,

(10) the base end portion of the second axle support is attached vertically movably to respective lower end portions of the longitudinal bodies, the base end portion of the second axle support having a downward gradient toward the opposite side to the traveling direction,

(11) the elastic member for energizing the second axle support in a direction away from the base frame is attached to each of the longitudinal bodies, and

(12) a width of the rear wheel in an axle length direction of the rear wheel is formed sufficiently longer than a width of the base frame.

4. The walking assistance device according to claim 3, wherein the base frame and the operation frame each include a metallic material, the holding portion of the operation frame is formed substantially horizontally, and a stopper including a curve plate is secured to a face on a rear-wheel side of the stopper portion of the base frame.

* * * * *